United States Patent [19]

Turney

[11] 4,030,710

[45] June 21, 1977

[54] FLOATING TUBE TORCH

[75] Inventor: Larry R. Turney, Denton, Tex.

[73] Assignee: Victor Equipment Company, Denton, Tex.

[22] Filed: Nov. 28, 1975

[21] Appl. No.: 636,072

[52] U.S. Cl. ..... 266/48; 239/397.5

[51] Int. Cl.[2] ..... B23K 7/02

[58] Field of Search ..... 148/9 R; 239/424, 424.5, 239/397.5; 266/48

[56] References Cited

UNITED STATES PATENTS

| | | | |
|---|---|---|---|
| 1,262,351 | 4/1918 | Jones et al. | 239/400 |
| 1,276,893 | 8/1918 | Fischer | 239/132.3 |
| 2,198,342 | 4/1940 | Jacobsson et al. | 239/424.5 X |
| 2,263,655 | 11/1941 | Stettner | 285/388 |
| 2,459,881 | 1/1949 | Jacobsson | 431/346 |
| 2,655,992 | 10/1953 | LeRenard | 431/346 |
| 3,078,913 | 2/1963 | Anthes | 239/397.5 |
| 3,228,612 | 1/1966 | Graham et al. | 239/397.5 |
| 3,612,738 | 10/1971 | Jones et al. | 431/346 X |

*Primary Examiner*—Roy Lake

*Assistant Examiner*—Paul A. Bell

*Attorney, Agent, or Firm*—James C. Fails

[57] ABSTRACT

A cutting torch that obviates the tendency to bow because of unequal heating of tubes therewithin and, consequently, keeps its tip at the same relative angle with respect to the material being cut, characterized by the usual tip, head, body, barrel, oxygen and fuel flow control valves and cutting oxygen valve and having the improvement of having both the pre-heat tube and the cutting oxygen tube assembly sealingly connected to the head and only one of the pre-heat tube and the cutting oxygen tube assembly sealingly and rigidly connected to the body and the other thereof slidably engaging the body so as to permit body movement longitudinally thereof to compensate for differential expansion between the slowly cooled pre-heat tube with its slow flow of oxygen and fuel and the more rapidly cooled cutting oxygen tube assembly with its periodic rapid flow of cutting oxygen. Also disclosed are specific structural details depict preferred embodiments, including a preferred type of mixing tube structure to eliminate sustained flashback burning.

4 Claims, 2 Drawing Figures

FLOATING TUBE TORCH

BACKGROUND OF THE INVENTION

1. Field of the Invention:

This invention relates to torches. More particularly, it relates to cutting torches having a plurality of tubes therewithin. In a particular aspect, it relates to an improvement in cutting torches, particularly the large machine cutting torches in which it is vital that the cutting tip maintain the same relative position with respect to the work piece, since there is no human welder to compensate for changes in this relationship.

2. Description of the Prior Art:

The advent of welding solved many problems that had plagued manufacturers earlier. The use of torches, such as cutting torches, welding torches, heating torches and the like also helped the repairman perform a variety of repairs on the site instead of having to return an article to the factory to be repaired. With the ever increasing costs of labor, there is a move toward increased automation. One of the problems; namely, bowing of a cutting torch; that has plagued the welder causes an intolerable variance when automated cutting or welding, as by machine cutting torches, is employed. Specifically, in the past, the tendency for manually employed torches to bow because of differential heating between the cutting oxygen tube and the mixing tube in the torch could be compensated for by the welder who watched the flame impinge upon the desired area and could control the tip to compensate and cut the desired portion. With machine welding, however, there is no manual compensation so it is vital that the cutting torch tip maintain the same relative relationship to the work piece as initially employed if the uniform arcs, circles and the like that are made by the machine are to be correctly translated into the cuts made by the torch tip.

A variety of attempts have been made in the prior art to correctly compensate for the variance. These attempts have included forceably holding the torch tip with respect to the work piece and allowing the top portion of the torch to bow; and making the tubes within the torch of different materials having different degrees of thermal expansion so as to try to compensate for the differential cooling. The first solution has resulted in some instability in the torch affixing and operation. The second has not compensated for the different degrees of thermal expansion because of the different modes in which the torch will be operated, including initial heating mode, followed by the high flow rate of cutting oxygen with its greater cooling of the cutting tube assembly.

Thus, it can be seen that the prior art has not provided a totally satisfactory solution to the problem of the tendency of the cutting torch to bow due to differential expansion of tubes therewithin; and, consequently, alter the relationship of the tip relative to the work piece. Expressed otherwise, there have been no satisfactory solutions to the cocking of the torch tip with respect to a work piece during cutting. Yet, it is vital that this problem be solved, particularly with respect to machine cutting torches.

SUMMARY OF THE INVENTION

Accordingly, it is an object of this invention to provide a cutting torch that obviates the tendency to bow because of unequal thermal expansion of tubes within the torch.

Specifically, it is an object of this invention to provide a cutting torch tip that can be employed in a machine cutting torch application and that will maintain the same relative relationship between the cutting torch tip and the work piece without inducing instability to the top of the torch by eliminating the strain induced by differential thermal expansion of the tubes within the torch.

These and other objects will become apparent from the following descriptive matter, particularly when taken in conjunction with the appended drawings.

In accordance with this invention, there is provided a cutting torch that obviates the tendency to bow because of unequal heating of tubes therewithin. The torch includes a torch head; a torch tip connected in fluid tight relationship with the torch head; a body having first and second passageways adapted to conformingly receive respective pre-heat tube assembly and cutting oxygen tube assembly; the body having a fuel inlet passageway and an oxygen inlet passageway; a barrel connecting the torch head with the body; respective fuel and oxygen flow control valves sealingly connected with the body and their respective passageways; a pre-heat tube assembly and a cutting oxygen tube assembly sealingly connected with the torch head; a cutting oxygen flow control valve being sealingly connected with the cutting oxygen tube assembly; characterized by at least one of the pre-heat tube and the cutting oxygen tube assembly being sealingly and rigidly connected with the body and the other thereof slidably engaging the body so as to permit body movement longitudinally thereof to compensate for differential expansion between the slowly cooled preheat tube with its slow flow of oxygen and fuel and the more rapidly cooled cutting oxygen tube with its periodic rapid flow of cutting oxygen.

DESCRIPTION OF PREFERRED EMBODIMENTS

Figure 1:
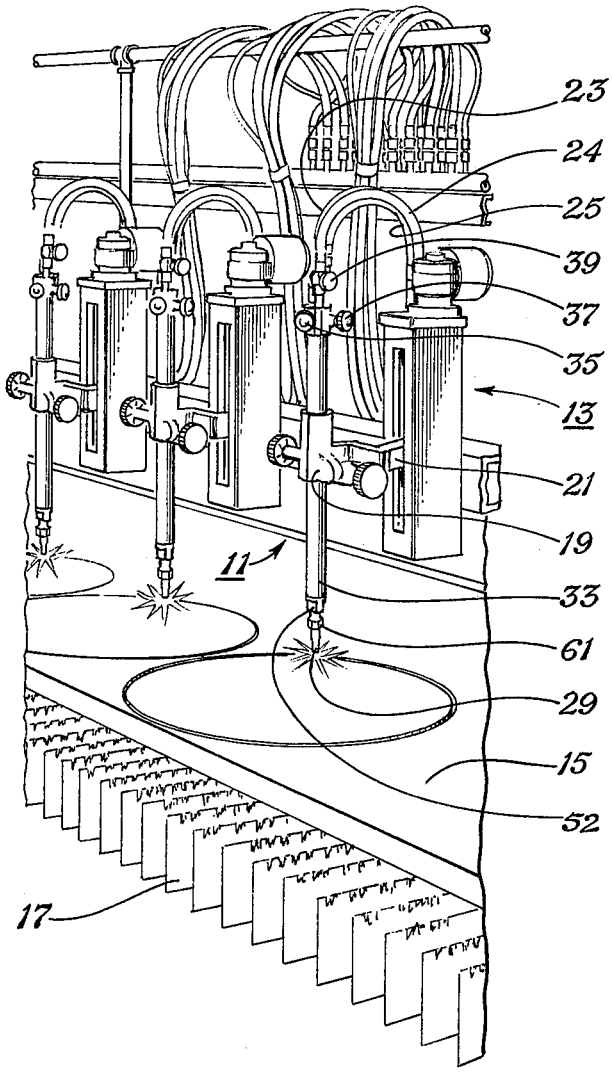
FIG. 1 is a perspective view of machine torches being employed in an automated cutting operation in accordance with one embodiment of this invention.
Figure 2:
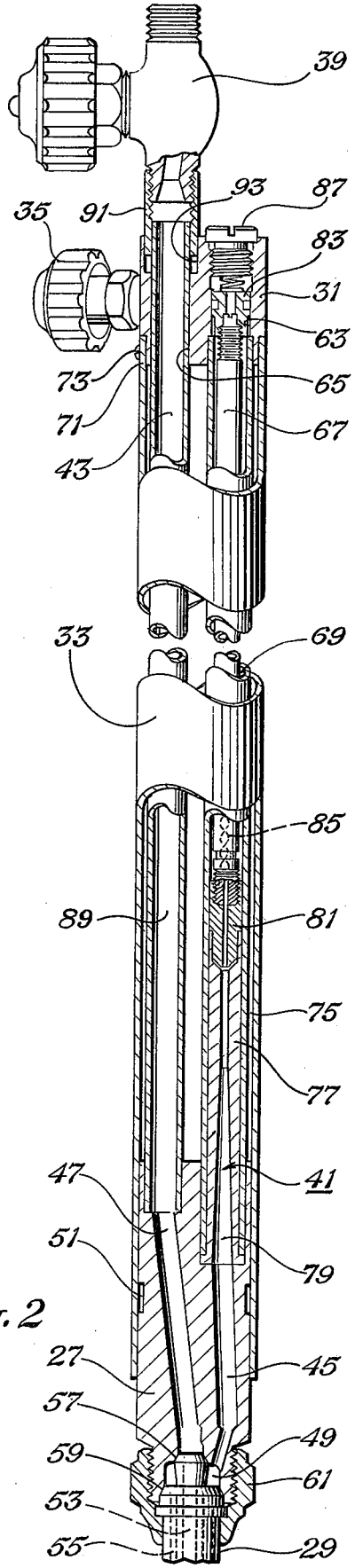
FIG. 2 is a side elevational view, partly shown in cross section and partly cut away, of the torch of FIG. 1.

Referring to FIGS. 1 and 2, there is illustrated the cutting torch 11 being employed in a cutting torch machine 13 for cutting a work piece 15 on a support 17. As illustrated, the cutting torch is held at mid-barrel by holder 19. The holder 19 is mounted on an arm 21 that can be raised and lowered by a conventional means responsive to usual controls (not shown). Also in accord with conventional practice, three hoses 23–25 supply, respectively, oxygen, fuel and cutting oxygen. Suitable controls, such as solenoid operated valves, can be employed to automate control of the cutting oxygen flow, in addition to control by the cutting oxygen flow control valve such as delineated later hereinafter.

The cutting machine 13, the associated holder, arm, controls and oxygen and fuel supply hoses and instrumentation are conventional; do not, per se, form a part of this invention; and need not be described in further detail herein.

The cutting torch 11 includes a torch head 27, a torch tip 29, a body 31, a barrel 33, a fuel flow control valve 35, an oxygen flow control valve 37, a cutting oxygen flow control valve 39, a pre-heat tube assembly 41, and a cutting oxygen tube assembly 43.

The torch head 27, FIG. 2, contains a pre-heat passageway 45 and a cutting oxygen passageway 47. As can be seen, the cutting oxygen passageway 47 terminates centrally of the torch head 27 whereas the pre-heat passageway 45 terminates eccentrically thereof in a concentric bore that will form a concentric annular chamber 49 in conjunction with the torch tip 29.

The torch head 27 comprises a cylindrically shaped block with appropriate bores and passageways and being formed, ordinarily, of a metal or other heat resistant material. Preferably, the torch head 27 is formed of brass or other copper or stainless steel alloys that resist corrosion by the oxygen at high temperature. The torch head 27 has a substantially smooth exterior for receiving the barrel 33. A groove 51 is provided on the exterior of the torch head 27. If desired, the torch head 27 may have a flatted portion 52, FIG. 1, for being held with a wrench or the like when the torch tip 29 is affixed thereto.

The torch tip 29 is a conventional cutting torch tip having a centrally disposed passageway 53 for the cutting oxygen and a plurality of passageways 55 disposed concentrically thereabout for the mixture of fuel and oxygen. In accordance with conventional practice, the torch tip 29 has a top shoulder 57 that sealingly abuts the mating portion of the torch head 27 such that the cutting oxygen passageways 53 and 47 are isolated from the fuel and oxygen chamber 49 and passageways 45 and 55. The torch tip 29 also has a frusto-conical section 59 that is held sealingly in place by a tip nut 61 so the torch tip is connected in fluid tight relationship with the torch head 27. The torch tip is ordinarily formed of a corrosion resistant metallic alloy such as copper alloy.

The cutting torch 11 has a body 31 having respective first and second passageways 63 and 65 for conformingly receiving the pre-heat tube assembly 41 and the cutting oxygen tube assembly 43. In accordance with conventional practice the body 31 also has a fuel inlet passageway and an oxygen inlet passageway that are adapted to sealingly receive the respective fuel flow control valve 35 and the oxygen flow control valve 37 and to conduct the respective gases to their respective conducting passageways. Specifically, the oxygen is conducted to an injector tube 67 and the fuel is conducted to the annular passageway 69 defined between the injector tube 67 and an outer tube 75, as will be described in more detail hereinafter. The respective fuel inlet and oxygen inlet passageways are conventional and need not be described in further detail herein.

The body is ordinarily formed of a metallic alloy, such as a copper alloy, so as to resist corrosion, yet sustain the relatively rough treatment that is frequently accorded by the workman. The body 31 has an annular recess 71 for conformingly receiving the barrel 33.

The fuel flow control valve and the oxygen flow control valve are conventional, are described in detail in other patents, such as U.S. Pat. No. 3,873,028, "Precision Torch Assembly", inventor Richard W. Miller, assigned to Victor Equipment Company, the contents of which are incorporated herein by reference.

The barrel 33 is connected with the body 31 at one end. The barrel 33 is also connected with the head 27 at its other end. The barrel 33 may be of plastic or metallic composition. Ordinarily, it is advantageously metallic, although it may advantageously employ plastic cover or the like where it is to be employed by hand to minimize the heat transmission. The barrel 33 may be affixed to the respective components; as by bonding, such as silver soldering or the like. If desired, it may simply conformingly fit with one end such as the torch head and be affixed, as by set screws 73, at the other end, as to the body 31. This arrangement facilitates disassembly so as to allow access to the cutting oxygen tube assembly and the pre-heat tube assembly therewithin.

The pre-heat tube assembly 41 includes an outer tube 75 of generally cylindrical shape and a mixer tube, or diffuser, 77 disposed concentrically therewithin. The mixer tube 77 actually serves as a diffuser for diffusing and intermixing the respective oxygen and fuel gas to form a readily combustible mixture. The mixer tube 77 has a frusto-conical section 79 that flares downwardly and outwardly as illustrated in FIG. 2. The mixer tube 77 is highly conductive to ensure that the mixture of fuel and oxygen is pre-heated to obtain best conduction, but is constructed to as to try to minimize flashback. As indicated hereinbefore, the pre-heat tube also contains an injector tube 67 that is inserted downwardly therewithin so that the bottom end extends to near the top end of the mixer tube 77. The injector tube 67 actually serves for injecting the oxygen into the fluid fuel being flowed down the annular passageway 69. The injector tube 67 terminates in a mixer 81 at its lower end and a gas separator 83 at it upper end. The mixer 81 also contains a spiral 85 that operates as described in my co-pending application entitled "Universal Torch" Ser. No. 635,854, filed Nov. 28, 1975, to minimize the danger from flashback and sustained burning in the torch and the like. The detailed description of that operation need not be described herein. It is sufficient to note that the oxygen and the fuel gas are maintained as discrete gases until they pass the mixer 81. Consequently, the chance of sustained combustion upstream of the mixer 81 is minimal. Moreover, because of the flaring effect of the frusto-conical nose portion of the mixer, a detonation wave that tended to be propagated upwardly in conventional torches, tends to be dissipated into the respective concentric annular passageway for the fuel and the interior passageway for the oxygen. Consequently, the detonation wave is broken up and normal flow is allowed to recommence for normal burning at the torch tip 29.

As illustrated, the pre-heat tube 41 is conformingly received and bonded to both the body 31 and the torch head 27. The bonding is typically by silver soldering because of the type construction of the alloys. An adjustment screw 87 is provided. Thus, the oxygen and fuel are flowed into their respective passageways and into the mixer 81 where they are admixed prior to heating during flow and combustion at the torch tip 29. Since the flow of preheat oxygen and fuel is relatively small, the components of the pre-heat tube assembly 41 are cooled slowly so there is a tendency for this tube to become relatively hot, in contrast to the periodic high flow of cutting oxygen through the cutting oxygen tube assembly 43.

The cutting oxygen tube assembly 43 includes the generally cylindrical tube 89 and the adapter 91. The cutting oxygen tube 89 may be formed of any material that is corrosion resistant to oxygen at relatively high temperatures. For example, it may be formed of stainless steel or a copper based alloy. As illustrated, the cutting oxygen tube 89 is conformingly received and affixed, as by silver soldering, to the torch head 27; and is conformingly and slidably received in the second passageway 65 of the body 31. This ability to accommodate sliding movement allows the body to be moved longitudinally of the cutting tube assembly 43 to compensate for differential expansion between the slowly cooled pre-heat tube assembly 41 and the more rapidly cooled cutting oxygen tube assembly 43. Specifically, the cutting oxygen tube 89, with its first diameter, is conformingly and slidably received within the second passageway 65 and is sealingly connected to a heating adapter 91 that is also conformingly and slidably received within a second bore 93 of the second passageway 65 in the body 31. The adapter 91 sealingly receives, as by threads, the cutting oxygen flow control valve 39.

In operation, the torch 11 is assembled and connected as illustrated and described hereinbefore. The desired heating flame is provided at the tip 29 by adjusting the fuel and oxygen flow control valves 35 and 37. The oxygen flow control valve 39 is adjusted to provide the desired cutting oxygen flow when oxygen is passed to the cutting oxygen passageway 53, as by a relay (not shown). The work piece 15 is moved into place on the support 17 and the torch 11 lowered to the heating position, as by movement of the arm 21 downwardly. When molten metal has been achieved, the cutting oxygen is passed through the cutting oxygen tube assembly 43 to begin the cutting. Thereafter, the machine traverses the desired cutting pattern, such as the circle shown in FIG. 1. After a cut is finished, cutting oxygen may be stopped, the torch is raised and a new work piece positioned under the torch and the operation repeated as desired.

While the machine torch embodiment has been illustrated herein, it is also advantageous to employ the sliding construction with one of either the cutting oxygen tube assembly or the pre-heat tube in a manually operated torch. Such construction allows the operator to concentrate on the cutting, without worrying about the tip assuming different attitudes because of the tendency of the torch to bow because of unequal heating of the tubes within the barrel 33.

While the cutting oxygen tube assembly 43 has been illustrated as the tube that is slidably received within the body 31, the pre-heat tube assembly 41 may be the assembly that is slidably received within the body 31 and the body structure altered. I have found it advantageous to employ the body 31 to contain both of the pre-heat valves for the oxygen and fuel and allow the cutting oxygen valve 39 to float, or move with respect to the body 31.

Although a cutting oxygen flow control valve for a machine torch has been illustrated and described hereinbefore, it may comprise a lever actuated cutting oxygen flow control valve such as employed for a manually operated torch.

One advantage of this invention is that the materials of construction that are ordinarily employed in manufacturing torches can be employed herein and no exotic new materials or expensive operations are necessary.

Although this invention has been described with a certain degree of particularity, it is understood that the present disclosure has been made only by way of example and that numerous changes in the details of construction and the combination and arrangement of parts may be resorted to without departing from the spirit and the scope of this invention.

I claim:

1. A cutting torch that obviates the tendency to bow because of unequal heating of tubes therewithin comprising:

a. a torch head;

b. a torch tip connected in fluid tight relationship with said torch head;

c. a body having a first passageway adapted to conformingly receive a pre-heat tube assembly and a second passageway adapted to conformingly receive a cutting oxygen tube assembly; said body having a fuel inlet passageway and an oxygen inlet passageway;

d. a barrel connected with said body;

e. a fuel flow control valve sealingly connected with said fuel inlet passageway of said body;

f. an oxygen flow control valve sealingly connected with said oxygen inlet passageway of said body;

g. a pre-heat tube assembly disposed within said barrel and connected with said fuel inlet passageway and said fuel flow control valve and with said oxygen inlet passageway and said oxygen flow control valve; said pre-heat tube assembly being sealingly connected to said torch head; said pre-heat tube assembly comprising an outer tube having inserted therewithin an injector tube and a mixer tube; said mixer tube having a bore traversing longitudinally thereof with its entrance adjacent the downstream end of said injector tube; said injector tube having a mixer at its downstream end, means spacing said mixer at a predetermined distance from entrance of said bore of said mixer tube, and at its upstream end a slidable gas separator for allowing expansion and contraction without varying said predetermined distance;

h. a cutting oxygen flow control valve;

i. a cutting oxygen tube assembly sealingly connected with said torch head and said cutting oxygen flow control valve; and j. said pre-heat tube assembly and said cutting oxygen tube assembly being disposed in side by side relationship; only one of said outer tube of said pre-heat tube assembly and said cutting oxygen tube assembly being sealingly and rigidly connected to said body and the other thereof slidably engaging said body so as to permit body movement longitudinally thereof to compensate for periodic differential expansion between the slowly cooled pre-heat tube assembly with its slow flow of oxygen and fuel therewithin and the more rapidly cooled cutting oxygen tube assembly with its periodic rapid flow of cutting oxygen therethrough and thereby preventing periodically altering the angle of said torch head and tip with respect to said barrel and body.

2. The torch of claim 1 wherein said outer tube of said pre-heat tube assembly is rigidly and sealingly connected with said body and said cutting oxygen tube assembly is slidably disposed within said body.

3. The torch of claim 2 wherein said cutting oxygen tube assembly includes a tube of a first diameter that is conformingly and slidably received within said first passageway of said body; said tube being sealingly connected to a heater adapter of a second diameter and said first passageway has a second bore that conformingly and slidably receives said heating adapter.

4. The torch of claim 1 wherein said pre-heat tube assembly includes:

as at least a part of said mixer tube a diffuser section adjacent the end of said pre-heat tube assembly nearest said torch head; said diffuser section having at least one substantially cylindrical bore and connected therewith a frusto-conical bore flaring downstream;

an annular passageway in said outer tube for passage of the fuel; said outer tube being connected in fluid tight relationship with said fuel inlet passageway and said fuel flow control valve;

as at least a part of said injector tube an inner tube section for the oxygen with which to admix and burn said fuel; said inner tube section being disposed within said outer tube and connected at its first end in fluid tight relationship with said oxygen inlet passageway and said oxygen flow control valve so as to transmit said oxygen alone to said mixer where it will be admixed with said fuel;

said mixer being disposed within a surrounding tube member in communication with said diffuser and said annular passageway; and mixer being connected with the second end of said inner tube section; said mixer having a mixer orifice extending longitudinally thereof for passing the relatively high pressure oxygen therefrom in a high speed jet for aspirating a low pressure fuel into admixture therewith in said diffuser; said mixer orifice being disposed downstream of said oxygen flow control valve and a spiral and having a length greater than four times its diameter for minimizing turbulence and forming an aspirating high speed jet that enables use of the torch with a plurality of fuels at a plurality of pressures; said mixer having an inwardly flaring frusto-conical section at its free end for deflecting a detonation wave outwardly into said annular passageway disposed thereabout for said fuel; and a spiral disposed within said inner tube section downstream of said oxygen flow control valve and adjacent and upstream of said mixer and said mixer orifice; said spiral being of a highly heat conductive material for conducting heat away from any portion of a combustion wave flashed thereinto to extinguish the combustion, being cooled by flow of oxygen therepast and being operable in conjunction with said mixer to prevent sustained burning from a flashback that occurs in said torch.

* * * * *